US006623149B2

(12) United States Patent
Leleve

(10) Patent No.: US 6,623,149 B2
(45) Date of Patent: Sep. 23, 2003

(54) HEADLAMP FOR A MOTOR VEHICLE WITH MOVABLE SHADING SCREEN

(75) Inventor: Joël Leleve, Bobigny Cedex (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/975,236

(22) Filed: Oct. 11, 2001

(65) Prior Publication Data

US 2002/0044451 A1 Apr. 18, 2002

(30) Foreign Application Priority Data

Oct. 12, 2000 (FR) ..... 00 13055

(51) Int. Cl.[7] ..... F21V 14/08

(52) U.S. Cl. ..... 362/512; 362/284; 362/507; 362/539

(58) Field of Search ..... 362/507, 512, 362/539, 284, 459, 487, 506, 509, 513, 538, 257, 277, 282, 317, 351, 319, 322, 323, 324

(56) References Cited

U.S. PATENT DOCUMENTS

| | | | | | |
|---|---|---|---|---|---|
| 2,015,935 | A | * | 10/1935 | Herring | 362/284 |
| 4,875,141 | A | * | 10/1989 | Miyauchi et al. | 362/284 |
| 5,060,120 | A | * | 10/1991 | Kobayashi et al. | 362/282 |
| 5,158,352 | A | * | 10/1992 | Ikegami et al. | 362/539 |
| 5,339,226 | A | * | 8/1994 | Ishikawa | 362/539 |
| 5,343,371 | A | * | 8/1994 | Kobayashi et al. | 362/538 |
| 5,379,196 | A | * | 1/1995 | Kobayashi et al. | 362/538 |
| 5,899,559 | A | * | 5/1999 | Lachmayer et al. | 362/539 |
| 6,354,721 | B1 | * | 3/2002 | Zattoni | 362/539 |

* cited by examiner

*Primary Examiner*—Alan Cariaso
*Assistant Examiner*—Ismael Negron
(74) *Attorney, Agent, or Firm*—Morgan & Finnegan, LLP

(57) ABSTRACT

A headlamp for a vehicle, including a framework and at least one shading screen mounted for rotation about a rotational axis with respect to the framework. The rotational axis is inclined with respect to a principal axis of illumination of the headlamp.

17 Claims, 2 Drawing Sheets

HEADLAMP FOR A MOTOR VEHICLE WITH MOVABLE SHADING SCREEN

FIELD OF THE INVENTION

The invention relates to headlamps for a vehicle, especially those equipped with a reflector of the elliptical type.

A headlamp of this kind conventionally comprises a light source, a reflector of the elliptical type, a first focus of which is situated in the vicinity of the source, a converging lens a focal plane of which passes close to a second focus of the reflector, and glazing for closing off the headlamp. In certain cases, the lens may consist of the glazing itself.

When such a headlamp has to generate a beam with a regulatory cut-off, such as a dipped beam or an anti-fog beam, it includes a mask or screen interposed between the light source and the lens, which shades the part of the light which otherwise would be propagated above this cut-off.

BACKGROUND OF THE INVENTION

One difficulty of this type of headlamp lies in the alteration of the profile of the cut-off. Such an alteration is needed especially when a headlamp designed, for example, for driving on the right, has to form a cut-off light beam adapted for driving on the left. It may also be desirable to produce a universal headlamp, selectively capable of generating a dipped beam, an anti-fog beam or a beam without a cut-off.

Document EP 0 794 382, for example, describes a headlamp equipped with a movable screen having a vertical sliding motion so as, on demand, to form a beam with a cut-off, and being controlled by an actuator for that purpose.

However, the changes of position of the masks of this type of headlamp take place with beam transitions which are either dazzling for an oncoming vehicle or else momentarily generate a truncated beam, which is dangerous in both cases.

In other cases, such as with the headlamp of document U.S. Pat. No. 5,673,990 with a screen tilting towards the front, the transition is visually less comfortable since it generates a blurring of the cut-off and/or chromatic distortion.

In an attempt to alleviate these drawbacks, there was proposed, in the document EP 0 780 624, a headlamp with a screen mounted movably in rotation about an axis parallel to the principal axis of the headlamp. However, this headlamp does not give entire satisfaction.

DISCUSSION OF THE INVENTION

One object of the invention is to provide a headlamp making it possible to generate one or more cut-off beams by means of a transition which is not dangerous and is visually comfortable.

With a view to achieving this object, a headlamp for a vehicle is provided according to the invention, including a framework and at least one shading screen movable mounted in rotation about a rotational axis with respect to the framework, in which the axis is inclined with respect to a principal axis of illumination of the headlamp.

Thus, the inclination of the axis entails a relatively gentle visual transition upon a change of beam. This movement of the screen does not generate any aberration. This transition is not dangerous. Moreover, the screen or the screens can be given relatively substantial dimensions without encountering problems of size in the headlamp.

The headlamp according to the invention may moreover exhibit at least one of the following characteristics:

- it includes at least two screens;
- it includes four screens;
- it includes screens which are rigidly fixed mutually;
- the or each screen has a profile of curved shape;
- the rotational axis is a secant to the principal axis;
- the rotational axis is a secant at a point situated to the front of the headlamp by reference to the screens;
- the rotational axis extends substantially in a vertical plane;
- it includes a rotational axis inclined upwards towards the front of the headlamp;
- the rotational axis is slightly inclined with respect to the horizontal plane;
- it includes several movable screens formed by different portions of the same support;
- the screens are formed by different free end edges of the support;
- it includes a support of generally conical shape;
- the screen, or at least one of the screens, is able to define one of the beams from among the following group:
  - dipped beam for driving on the left;
  - dipped beam for driving on the right;
  - dipped beam for driving in wet weather;
  - dipped beam for motorway driving; and
  - main beam,
- it further includes one screen rigidly fixed to the framework;
- the fixed screen is able to interact with the movable screen or at least one of the movable screens so as to form one beam of the headlamp;
- it includes a reflector in the shape of a rotationally symmetric ellipsoid.

Other characteristics and advantages of the invention will emerge further on reading the following description of a preferred embodiment, given by way of non-limiting example.

DESCRIPTION OF A PREFERRED EMBODIMENT OF THE INVENTION

Figure 1:
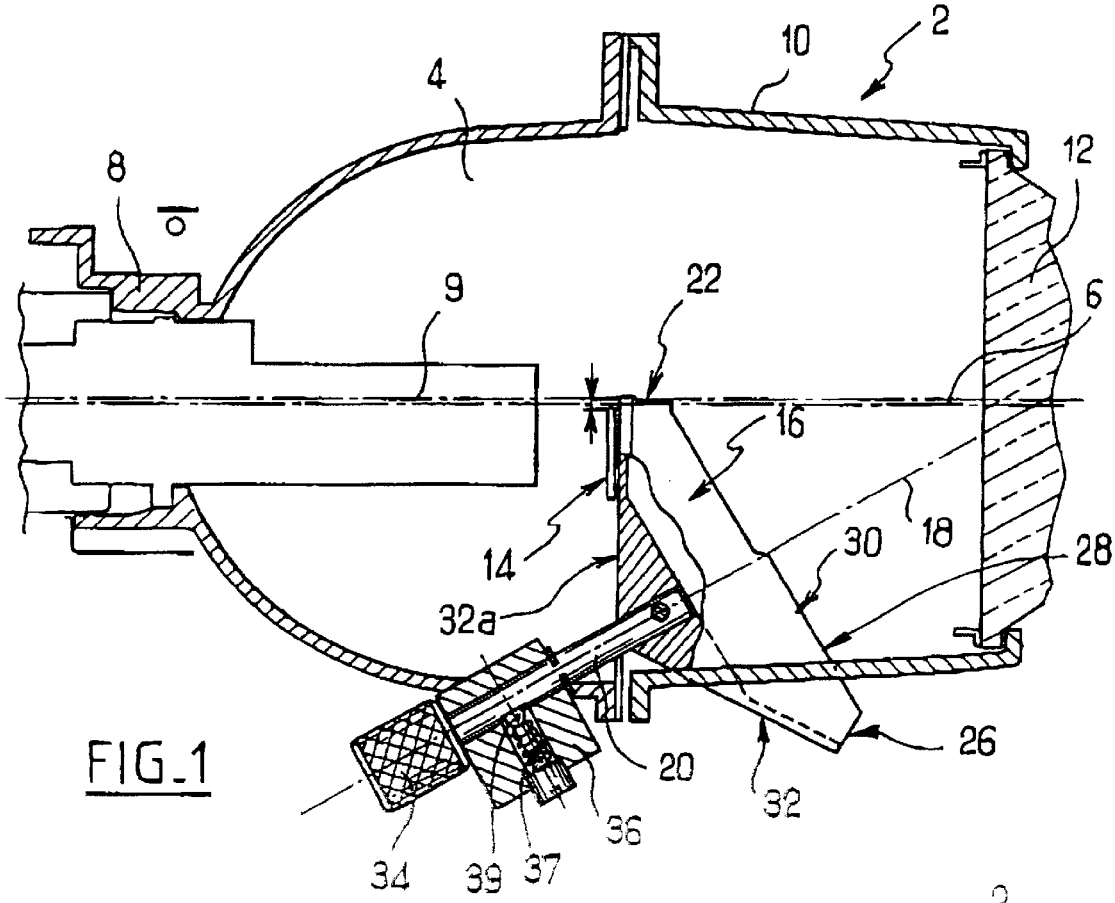
FIG. 1 is a sectional view along a vertical longitudinal plane of a headlamp according to a preferred embodiment of the invention.

In the embodiment illustrated in the figures, the headlamp 2 includes a reflector 4 in the shape of an ellipsoid rotationally symmetric about a horizontal longitudinal axis 6 forming a principal direction of illumination of the headlamp. The headlamp includes a lamp holder 8 fixed to the reflector at its rear part. The headlamp also includes a lens holder 10 fixed at the front part of the reflector 4 and a lens 12 fixed at the front part of the lens holder, a local plane of the lens passing close to a second focus of the reflector. The lamp holder, the reflector, the lens holder and the lens appear in succession along the axis 6. The reflector 4 and the lens holder 10 here constitute a framework of the headlamp. The headlamp may further comprise a housing enclosing these elements.

The headlamp includes a screen 14 rigidly fixed to the framework. The screen 14 has a curved shape, substantially cylindrical with a vertical generatrix and center of curvature situated towards the front of the headlamp. The screen 14 extends vertically over a low height and horizontally over approximately the entire width of the lamp holder. It features a horizontal upper edge extending at 0.5% below the axis 6 by reference to the focus of the lens 12. This fixed screen avoids any risk of dazzling during the movement of the screen-support piece as will be seen later. This screen is fixed by two lateral lugs 15 pinched and sandwiched between the edges of the reflector and of the lamp holder.

The headlamp includes a support piece 16 of generally conical shape although its shape is not strictly that of a cone. The piece 16 is mounted movable in rotation about an axis 18, the axis of the "quasi-cone". This axis extends in a vertical plane and is a secant to the principal axis 6. It cuts this axis in front of the fixed screen 14, approximately in the region of the lens 12.

The support piece 16 is fixed rigidly to a shaft 20 extending along the axis 18.

The support piece 16 forms four movable screens 22, 24, 26, 28, each able to intercept a portion of the beam reflected by the reflector 4 when the screen extends in the vicinity of the principal axis 6.

The support piece 16 is mounted movable in rotation about its axis 18 in such a way that it can occupy four positions with respect to the framework, which are separated from one another by a quarter-turn and corresponding to the interactions of the respective screens with the beam.

Figure 2:
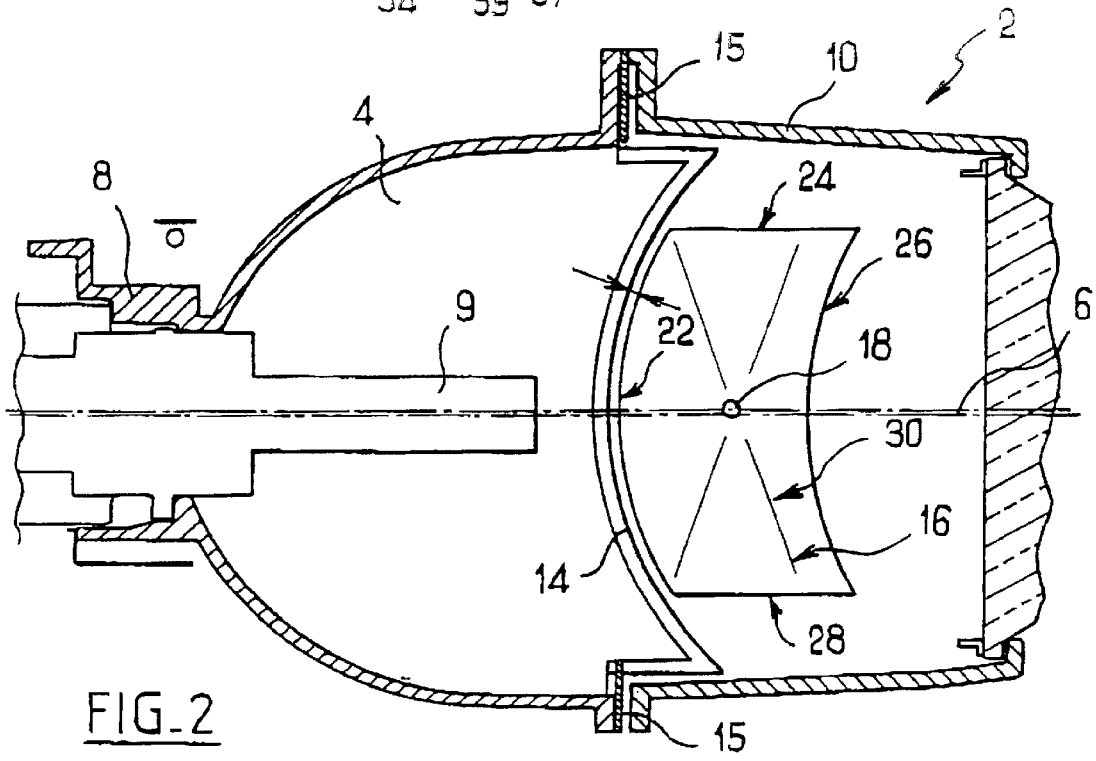
FIG. 2 is a sectional view along a horizontal longitudinal plane of the headlamp of FIG. 1, the screen support being illustrated seen from above.
Figure 3:
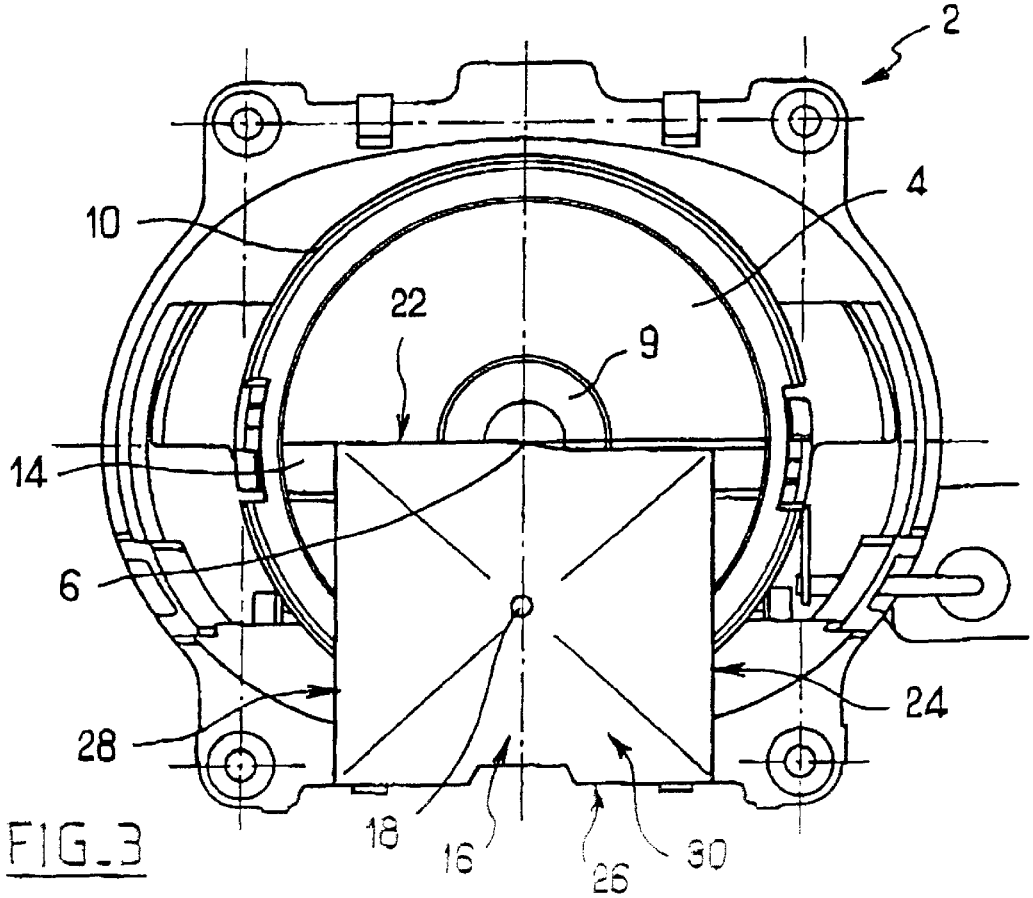
FIG. 3 is a front view of the headlamp of FIGS. 1 and 2.

First of all, the support piece 16 will be described when the screen 22 is interacting with the beam, as in the figures. This interaction makes it possible to define the entire upper quarter of the support piece. Thus, the support piece features a front face 30 centered on the axis 18 and inclined upwards and forwards. It also includes a "quasi-conical" face 32 a portion 32*a* of which, associated with the screen 22, extends rearwards overall in FIGS. 1 to 3. The generatrix of the portion 32*a* of this face 32 intercepting the vertical sectional plane in FIG. 1 is vertical.

Figure 4:
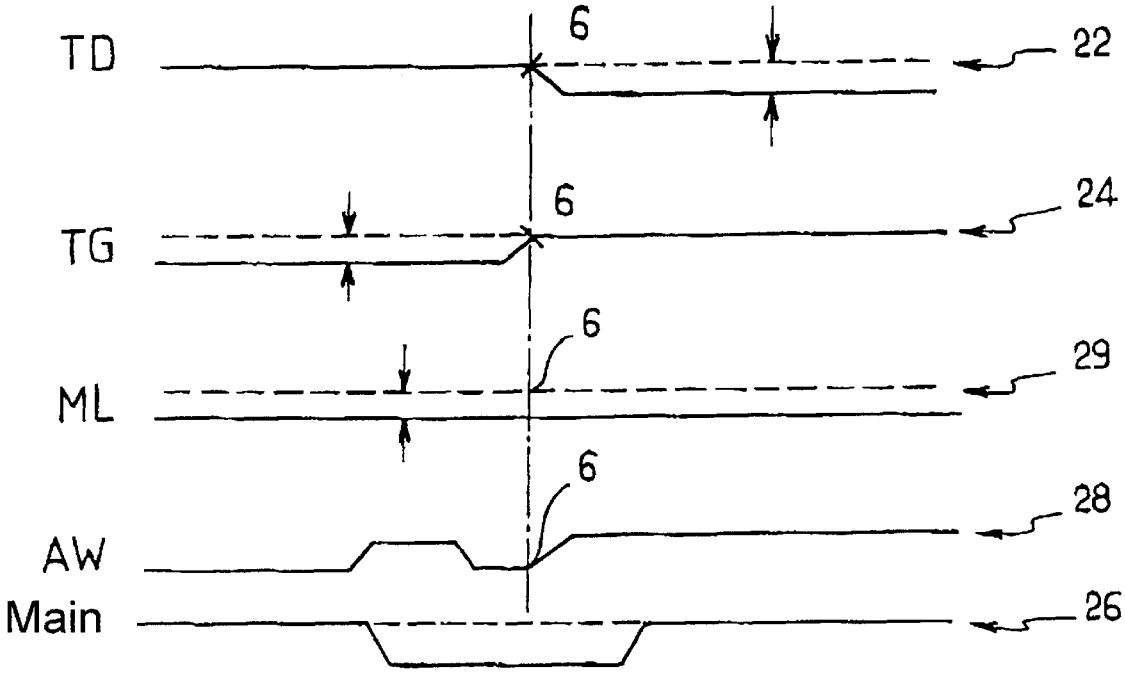
FIG. 4 shows five cut-off profiles associated with the screen of the headlamp of FIG. 1.

The screen 22 is formed at the junction between the portion 32*a* and the face 30. This junction extends from one of its extremities to the other in a general horizontal plane passing close to the axis 6, as FIG. 1 shows. Moreover, this junction, seen from above, has a generally curved shape similar to that of the fixed screen 14. In fact, the movable screen 22 extends over the entire width at a distance from the fixed screen 14, this distance being small and essentially constant along the fixed screen. However, the extremities of the fixed screen extend laterally beyond those of the movable screen 22 which is shorter. The junction between the portion 32*a* and the face 30 is truncated by an edge face with a certain thickness constituting the screen 22. This edge face has generatrices intersecting at the focus of the lens 6. The generatrix at the axis 6 is coincident with this axis. The cut-off profile is that referenced TD in FIG. 4, and is able, in a conventional way, to generate a dipped beam for driving on the right. The rear portion 32*a* is shaped so as to link the edge face constituting the movable screen 22 to the shaft 20 in the least bulky way possible. It has a shape approaching that of a conical portion.

The other three parts of the support piece 16 are defined in a similar way in association with the other three screens 24, 26 and 28. The front face 30 thus has a generally square shape, having curved edges with center of curvature turned towards the front. The movable screens 24, 26 and 28 here are shaped so as to define beams, which are known in themselves and illustrated respectively in FIG. 4. These are, respectively, a dipped beam for driving on the left (TG), a main beam and a dipped beam for driving on a wet roadway (AW). The latter, in addition to the cut-off of the dipped beam, avoids illuminating the region of the road situated in front of the vehicles coming in the opposite direction. Thus the drivers are not dazzled by the beam which otherwise would be reflected in their direction. In substitution for one of the screens 23, 24 and 28, it would be possible to equip the support piece with a screen 29 forming a dipped beam for motorway driving (ML).

The headlamp includes an actuator 34 in the form of a stepper motor with shaft 20, controllable by the driver from the dashboard of the vehicle. This actuator is associated with a stabilization device 36 comprising a duct 37 radial to the shaft 20 and opening out into it, in which a ball 39 is movable, pushed towards the shaft by means of a spring. The shaft features four ball housings corresponding to the four positions of the support piece. This device reduces the risk of inadvertent rotation of the support piece 16 without the motor being actuated.

The actuator 34 makes it possible to make the four screens 22, 24, 26, 28 turn in rotation about the axis 18 and to position the support piece in such a way as to define the cut-off with the movable screen selected by the driver according to circumstances.

The support piece 16 can be produced in such a way that its largest dimension, for example between the extreme edges of two opposite screens, is less than about five centimeters. It may, moreover, be produced from a metal material of slender thickness, for example a few tenths of a millimeter. It results therefrom that the movable support part for the various types of screens exhibits only very low inertia.

Such a structure exhibits numerous advantages. In the first place, the actuator 34 may be of only low power, of the order of 1 to 2 Watts. Such an actuator will then be inexpensive, and will consume only a small amount of electric current. It would even be possible to use a friction-type actuator system moved by a deformable piezoelectric element. In the second place, the response time of this structure could be very short; it is possible to tilt from one position to another by rotation at high speed, the transition time between two positions being of the order of 100 milliseconds. With switching times of this order of magnitude, the driver of the vehicle will not sense any difficulty which might be caused by the shape of the cut-off in a transition phase. Likewise, the drivers of vehicles coming in the opposite direction do not risk being dazzled upon a change of cut-off.

The lamp 9 could be a halogen lamp or a discharge lamp.

The actuator 34, the stabilization device 36 and the support piece 16 could extend wholly or partly through lower apertures in the reflector 4 and/or in the lens holder 10. These apertures are practically invisible from the outside of the headlamp. Moreover, they leave the operation of the headlamp practically unimpaired.

In particular, the lower apertures of the headlamp 2 do not substantially impair the beam formed by the headlamp.

In the embodiment which has just been described, the motor, the stabilization device and the screen support extend facing a region of the reflector which is of little importance in defining the beam and therefore not prejudicial to its formation.

For preference, when a movable screen extends close to the axis 6 in the position for forming a cut-off, its distance to the fixed screen will be of 0.1 to 0.2 mm.

Because of the inclination of the axis 18 with respect to the principal axis 6, and, furthermore, because of the presence of the fixed screen 14, the changes of position of the screens or masks take place by way of transitions which are not dangerous (no dazzling and no beam reduction) and relatively comfortable (no generation of blurring of cut-off nor of chromatic distortion).

The inclination of the axis 18 combined with the conicity offers the advantage that the edge of the screens closely follows the curve of the edge of the lens 12, which, to a first approximation, can be likened to a circle. This arrangement is particularly favorable for obtaining optimal optical quality for the beam. Depending on the specific configuration of each headlamp, and of each lens in particular, especially its dimensions and its focal length, it is easily possible to find an optimal inclination of the axis 18 so that the edges of the screens closely follow the curve of the edge of the lens in question. An inclination of the axis 18 with respect to the optical axis 6 lying between 5 and 50°, depending on the lens in question, makes it possible to fulfil this condition. With a headlamp currently in mass production, an angle of 20° has given the best results.

The headlamp according to the invention also has the advantage that the mechanical device is particularly simple even when it is associated with a large number of movable screens.

The reduced size of the motor 34, combined with the inclination of the axis 18, makes it possible to house the motor 34 practically inside the volume delimited by the reflector 4 and the lens holder 10, the headlamp thus equipped having the same size, and the same appearance, as a headlamp having only a single fixed screen procuring a single cut-off.

Numerous variations may be applied to the invention without departing from the scope thereof.

The support piece 16 could be associated with a number of screens other than 4, for example 2, 3, 5 or more. It could even be associated with a single screen.

Provision could be made for the rotational axis 18 of the support piece for the movable screens to be slightly inclined with respect to the median vertical axis of the headlamp if that is advantageous in terms of size or of optical performance. This inclination will preferably not exceed a few degrees. Other types of cut-off beams to those described above can be envisaged in association with the present invention.

What is claimed is:

1. A headlamp for a vehicle, including a framework and at least one shading screen movable mounted for rotation about a rotational axis with respect to the framework, wherein said axis is inclined with respect to a principal axis of illumination of the headlamp.

2. The headlamp according to claim 1, wherein it includes four screens.

3. The head lamp according to claim 1, wherein the or each screen has a profile of curved shape.

4. The headlamp according to claim 1, wherein the rotational axis is a secant to the principal axis.

5. The headlamp according to claim 1, wherein the rotational axis is a secant to the principal axis at a point situated at the front of the headlamp by reference to the screens.

6. The headlamp according to claim 1, wherein the rotational axis extends substantially in a vertical plane.

7. The headlamp according to claim 1, wherein the rotational axis is inclined upwards towards the front of the headlamp.

8. The headlamp according to claim 1, wherein the rotational axis is inclined with respect to the horizontal plane.

9. The headlamp according to claim 1, wherein the screen or at least one of the screens is able to define one of the beams from among one of the following group:

a dipped beam for driving on the left;

a dipped beam for driving on the right;

a dipped beam for driving in wet weather;

a dipped beam for motorway driving; and a main beam.

10. The headlamp according to claim 1, wherein it includes a reflector in the shape of a rotationally symmetric ellipsoid.

11. The headlamp according to claim 1, wherein it further includes one screen rigidly fixed to the framework.

12. The headlamp according to claim 11, wherein the fixed screen is able to interact with the movable screen or at least one of the movable screens so as to form one beam of the headlamp.

13. The headlamp according to claim 1, wherein it includes at least two screens.

14. The headlamp according to claim 13, wherein the screens are mutually rigidly fixed.

15. The headlamp according to claim 1, wherein it includes several movable screens formed by different portions of a support.

16. The headlamp according to claim 15, wherein the screens are formed by different free end edges of the support.

17. The headlamp according to claim 15, wherein the support has a generally conical shape.

* * * * *

UNITED STATES PATENT AND TRADEMARK OFFICE

CERTIFICATE OF CORRECTION

PATENT NO. : 6,623,149 B2
DATED : September 23, 2003
INVENTOR(S) : Joël Leleve

It is certified that error appears in the above-identified patent and that said Letters Patent is hereby corrected as shown below:

Title page,
Item [56], References Cited, U.S. PATENT DOCUMENTS, immediately following the last U.S. PATENT DOCUMENT, 6,354,721 B1, please insert the following:
-- 6,116,764 9/2000 Eichhorn, et al. ……... 362/512
5,339,226 8/1994 Ishikawa …… 362/61

FOREIGN PATENT DOCUMENTS 0 900 972 A1 03/1999 (EP) …… F21M/3/18
3415867 A1 10/1985 (DE) ……... F21M/3/14 --

Signed and Sealed this

Twenty-third Day of March, 2004

JON W. DUDAS
*Acting Director of the United States Patent and Trademark Office*